US011114732B2

(12) United States Patent
Ushijima et al.

(10) Patent No.: US 11,114,732 B2
(45) Date of Patent: Sep. 7, 2021

(54) WAVEGUIDE NON-REFLECTIVE TERMINATOR AND WAVEGUIDE CIRCUIT

(71) Applicant: MITSUBISHI ELECTRIC CORPORATION, Tokyo (JP)

(72) Inventors: Yu Ushijima, Tokyo (JP); Hidenori Yukawa, Tokyo (JP); Takeshi Oshima, Tokyo (JP); Motomi Watanabe, Tokyo (JP); Naofumi Yoneda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/495,063

(22) PCT Filed: May 22, 2017

(86) PCT No.: PCT/JP2017/019043
§ 371 (c)(1),
(2) Date: Sep. 17, 2019

(87) PCT Pub. No.: WO2018/216072
PCT Pub. Date: Nov. 29, 2018

(65) Prior Publication Data

US 2020/0274218 A1 Aug. 27, 2020

(51) Int. Cl.

| | |
|---|---|
| ***H01P 1/26*** | (2006.01) |
| ***H01P 1/28*** | (2006.01) |
| ***H01P 3/12*** | (2006.01) |

(52) U.S. Cl.
CPC ..... *H01P 1/28* (2013.01); *H01P 1/264* (2013.01); *H01P 3/12* (2013.01)

(58) Field of Classification Search
CPC .... H01P 1/264; H01P 1/26; H01P 1/24; H01P 1/222; H01P 1/22; H01P 1/23; H01P 1/28; H01P 3/12
USPC ..... 333/22 R, 81 B
See application file for complete search history.

(56) References Cited

U.S. PATENT DOCUMENTS

| | | | | |
|---|---|---|---|---|
| 2005/0017815 | A1 | 1/2005 | Asao et al. | |
| 2014/0077901 | A1* | 3/2014 | Uhm | H01P 1/264 333/22 R |

FOREIGN PATENT DOCUMENTS

| | | | | |
|---|---|---|---|---|
| JP | 2005-045341 | A | 2/2005 | |
| JP | 2007-259046 | A | 10/2007 | |
| RU | 2297697 | * | 1/2007 | H01P 1/26 |

OTHER PUBLICATIONS

Extended European Search Report issued in corresponding European Application No. 17910947.5 dated Mar. 18, 2020.

* cited by examiner

*Primary Examiner* — Stephen E. Jones
(74) *Attorney, Agent, or Firm* — Birch, Stewart, Kolasch & Birch, LLP.

(57) ABSTRACT

A waveguide unit (2) is closed at one end thereof by a short circuit plane (2*a*) provided with through holes (3-1 to 3-6). Radio wave absorbers (4-1 to 4-6) absorb a frequency signal being a non-reflective target in the state of being inserted through the through holes (3-1 to 3-6) toward the inside of the waveguide unit (2) and contacting inner surfaces (3'-1 to 3'-6) of the through holes (3-1 to 3-6).

13 Claims, 6 Drawing Sheets

WAVEGUIDE NON-REFLECTIVE TERMINATOR AND WAVEGUIDE CIRCUIT

TECHNICAL FIELD

The present invention relates to a waveguide non-reflective terminator and a waveguide circuit for transmitting signals of microwaves or millimeter waves.

BACKGROUND ART

A waveguide non-reflective terminator, which is disclosed in Patent Literature 1, for example, has an opening being rectangular in a plane perpendicular to the propagation direction of radio waves, and includes a waveguide unit opened at one end thereof in the propagation direction of radio waves and closed at the other end thereof by a terminating metallic inner wall, and a radio wave absorber disposed inside the waveguide unit.

CITATION LIST

Patent Literatures

Patent Literature 1: JP 2005-45341 A

SUMMARY OF INVENTION

Technical Problem

In recent years, a layering fabrication technique of piling up resin material or metallic material to form a shape has been rapidly developed, and components formed by the layering fabrication are used in various fields.

However, since the waveguide non-reflective terminator disclosed in Patent Literature 1 has a configuration in which the radio wave absorber is disposed inside the waveguide unit, manufacturing based on the layering fabrication is difficult.

For example, when a radio wave absorber is disposed in a middle of the layering fabrication of the waveguide unit, it is necessary to carry out the layering fabrication for closing the waveguide unit after the radio wave absorber is disposed, which is technically difficult.

Furthermore, after the waveguide unit is completely formed by the layering fabrication, it is required to dispose the radio wave absorber inside the waveguide unit from its rectangular opening, which is a highly complex process.

The present invention has been conceived to solve the problems described above, and an object of the present invention is to provide a waveguide non-reflective terminator and a waveguide circuit suitable for manufacturing based on layering fabrication.

Solution to Problem

A waveguide non-reflective terminator according to the present invention includes: a waveguide unit whose one end is closed by a short circuit plane provided with a plurality of through holes; and a plurality of radio wave absorbers absorbing a frequency signal being a non-reflective target in a state of being inserted through the plurality of through holes toward an inside of the waveguide unit and contacting with inner surfaces of the plurality of through holes, respectively.

Advantageous Effects of Invention

According to the present invention, a function as a terminator can be realized by disposing a radio wave absorber in each of the plurality of through holes in the short circuit plane of the waveguide unit. Separately from the fabrication process of the radio wave absorber, only the waveguide unit can be formed by layering fabrication, so that it is possible to provide a terminator suitable for manufacturing based on layering fabrication.

DESCRIPTION OF EMBODIMENTS

Hereinafter, some embodiments for carrying out the present invention will be described to explain the present invention in more detail with reference to the accompanying drawings.

First Embodiment

Figure 1:
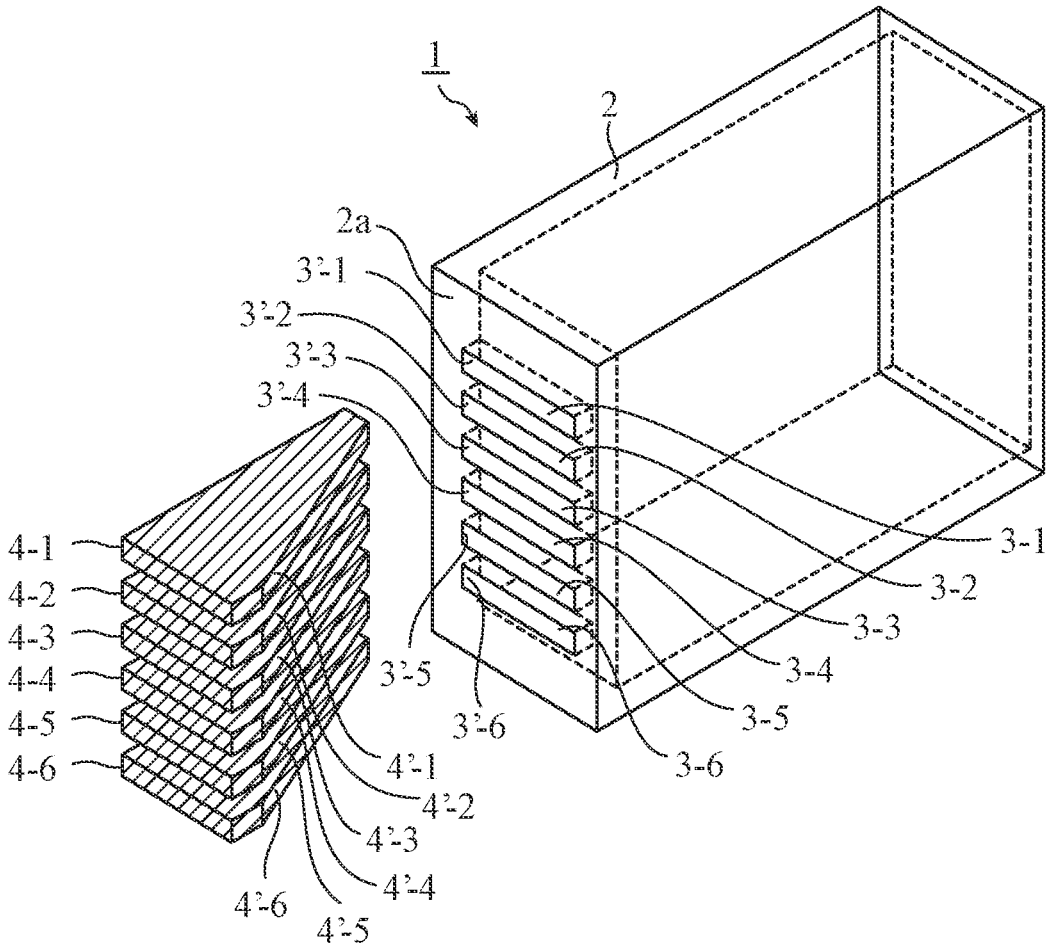
FIG. 1 is an exploded perspective view illustrating a configuration of a waveguide non-reflective terminator according to a first embodiment of the present invention.
Figure 2:
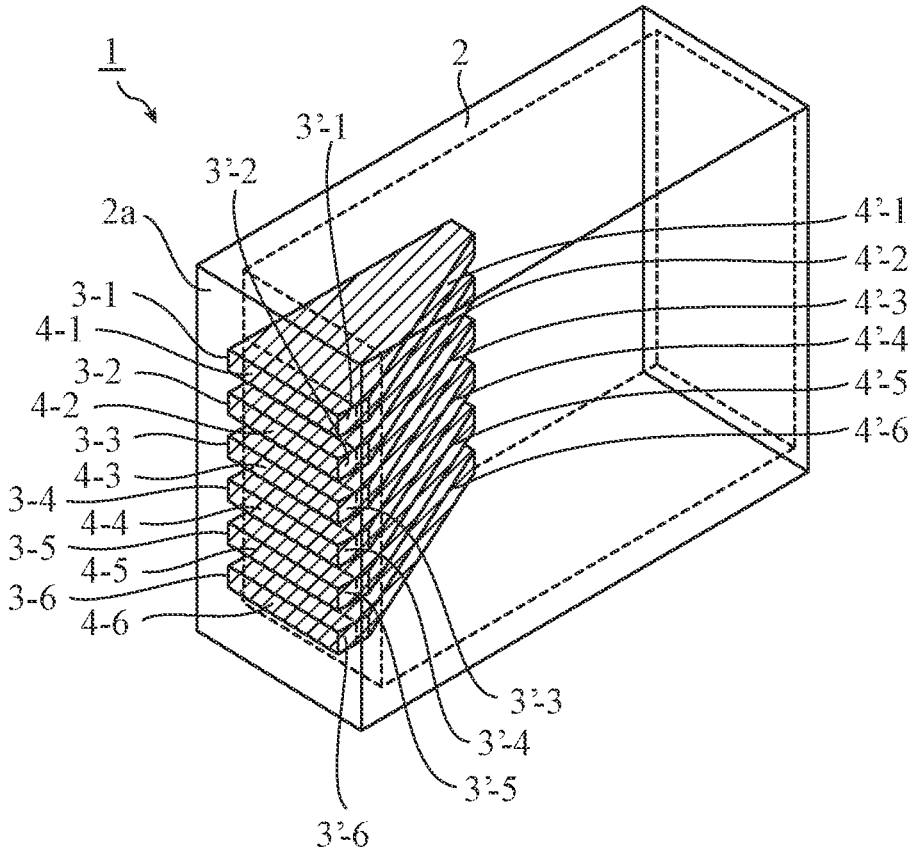
FIG. 2 is a perspective view illustrating the configuration of the waveguide non-reflective terminator according to the first embodiment.

FIG. 1 is an exploded perspective view illustrating a configuration of a waveguide non-reflective terminator 1 according to a first embodiment of the present invention, which illustrates a state before loading of radio wave absorbers 4-1 to 4-6 in a waveguide unit 2. FIG. 2 is a perspective view illustrating a configuration of the waveguide non-reflective terminator 1, which illustrates a state after loading of the radio wave absorbers 4-1 to 4-6 in the waveguide unit 2. In FIGS. 1 and 2, walls of the waveguide unit 2 are transparently illustrated to show the inside of the waveguide unit 2.

As illustrated in FIGS. 1 and 2, the waveguide non-reflective terminator 1 includes the waveguide unit 2 and the radio wave absorbers 4-1 to 4-6, and causes the radio wave absorbers 4-1 to 4-6 to absorb (terminate) signals that propagate inside the waveguide unit 2. The signals to be absorbed by the radio wave absorbers 4-1 to 4-6 are frequency signals being non-reflective targets.

The waveguide unit 2 is a rectangular waveguide closed at one end thereof by a short circuit plane 2*a*. The traveling direction of radio waves in the waveguide unit 2 is a direction perpendicular to the short circuit plane 2*a*. The short circuit plane 2*a* is one end face of the waveguide unit 2, which is electrically short-circuited to close the waveguide unit 2.

Note that, although the rectangular waveguide unit 2 is described, the waveguide unit 2 may be a cylindrical waveguide. That is, a waveguide unit 2 having a rectangular or cylindrical shape may be used as long as the waveguide has a short circuit plane 2*a* provided with a plurality of through holes.

Each of through holes 3-1 to 3-6 is a rectangular hole piercing through the short circuit plane 2*a*, and has a dimension in which signals do not propagate in a signal frequency band.

The dimension in which signals do not propagate is, for example, in a rectangular waveguide, by representing the long side length of the through hole by a and the short side length thereof by b, a dimension in which the long side length a is equal to or less than $\lambda c/2$, in which $\lambda c$ represents a cutoff frequency.

Although an example where six through holes are provided in the short circuit plane 2*a* and the radio wave absorber is inserted into each of the six through holes is illustrated in FIGS. 1 and 2, it is sufficient to provide two or more through holes and radio wave absorbers.

Although the rectangular through holes 3-1 to 3-6 are described, the through holes 3-1 to 3-6 may be circular holes. That is, it is only required for the through holes 3-1 to 3-6 to be in hole shapes corresponding to the shapes of the radio wave absorbers 4-1 to 4-6 as long as signals do not propagate to the outside of the waveguide unit 2 through the through holes 3-1 to 3-6.

In addition, although an example where each of the through holes 3-1 to 3-6 has the same shape and the same dimension is illustrated in FIGS. 1 and 2, no limitation is intended by this example.

For example, as long as signals do not propagate to the outside of the waveguide unit 2 through the through holes 3-1 to 3-6, the respective through holes 3-1 to 3-6 may have different shapes corresponding to the shapes of the radio wave absorbers 4-1 to 4-6, or may have different dimensions.

Each of the radio wave absorbers 4-1 to 4-6 is a tabular member made of lossy material that absorbs radio waves. As the lossy material, metallic powder solidified with epoxy resin as a resistance component, or ceramic material represented by ferrite is used.

The radio wave absorbers 4-1 to 4-6 have inclined surfaces 4'-1 to 4'-6 each forming a tapered shape inclined from one end toward the other end, respectively.

The radio wave absorbers 4-1 to 4-6 are inserted, from their respective ends having the inclined surfaces 4'-1 to 4'-6 each forming a tapered shape, into the through holes 3-1 to 3-6, respectively.

The ends of the radio wave absorbers 4-1 to 4-6 having the inclined surfaces 4'-1 to 4'-6 each forming a tapered shape are disposed inside the waveguide unit 2 along the propagation direction of radio waves.

The radio wave absorbers 4-1 to 4-6 are inserted through the through holes 3-1 to 3-6, respectively, from the outside to the inside of the waveguide unit 2, and set to a state of contacting with inner surfaces 3'-1 to 3'-6 of the through holes 3-1 to 3-6. In other words, the through holes 3-1 to 3-6 are closed by the radio wave absorbers 4-1 to 4-6 without any gap, respectively.

Figure 3:
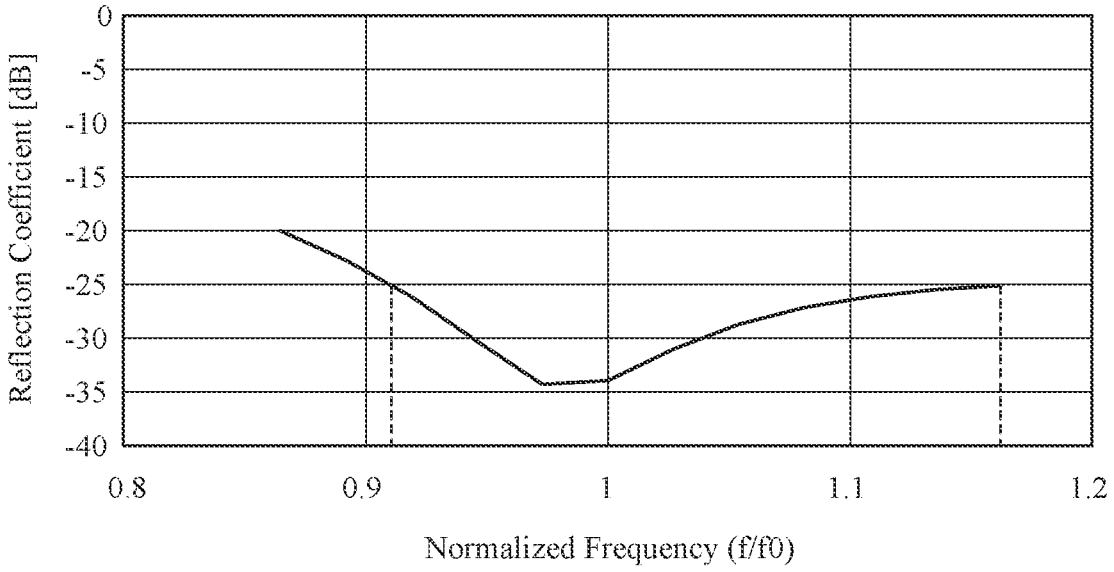
FIG. 3 is a graph illustrating reflection characteristics of the waveguide non-reflective terminator according to the first embodiment.

FIG. 3 is a graph illustrating reflection characteristics of the waveguide non-reflective terminator 1, which shows a relationship between a reflection coefficient and a normalized frequency. In FIG. 3, the normalized frequency is obtained by normalizing a signal frequency f with the central frequency f0 in designing (f/f0). The reflection coefficient is a result obtained by an electromagnetic field analysis simulation being carried out on the waveguide non-reflective terminator 1.

As illustrated in FIG. 3, the reflection coefficient is equal to or less than −25 dB in the normalized frequency range of 0.91 to 1.16, so that it can be seen that signals are absorbed.

In this manner, the waveguide non-reflective terminator 1 functions as a terminator by disposing the radio wave absorbers 4-1 to 4-6 through the through holes 3-1 to 3-6, respectively. As a result, it is possible to form only the waveguide unit 2 by layering fabrication separately from the radio wave absorbers 4-1 to 4-6, so that it is possible to provide a terminator suitable for manufacturing based on layering fabrication.

Furthermore, the through hole and the radio wave absorber may have various shapes.

Figure 4:
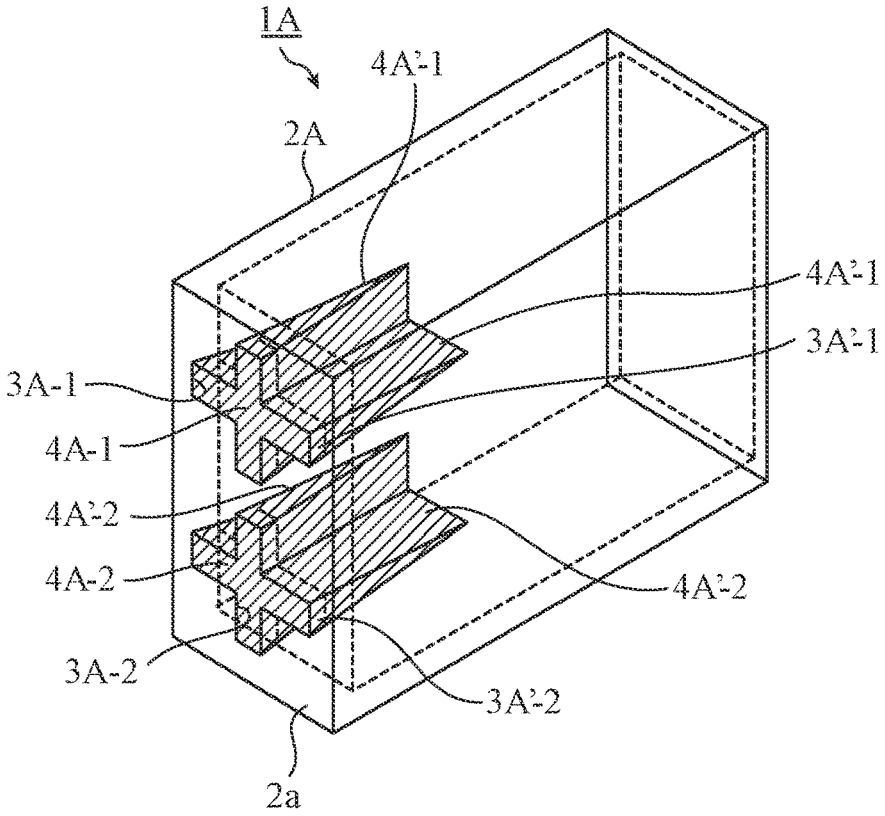
FIG. 4 is a perspective view illustrating another configuration of the waveguide non-reflective terminator according to the first embodiment.

FIG. 4 is a perspective view illustrating another configuration of the waveguide non-reflective terminator according to the first embodiment.

A waveguide non-reflective terminator 1A illustrated in FIG. 4 includes a waveguide unit 2A and radio wave absorbers 4A-1 and 4A-2, and causes the radio wave absorbers 4A-1 and 4A-2 to absorb (terminate) signals that propagate inside the waveguide unit 2A. The signals to be absorbed by the radio wave absorbers 4A-1 and 4A-2 are frequency signals being non-reflective targets.

Note that, in FIG. 4, walls of the waveguide unit 2A are transparently illustrated to show the inside of the waveguide unit 2A.

The waveguide unit 2A is a waveguide closed at one end thereof by the short circuit plane 2*a* provided with through holes 3A-1 and 3A-2. The through holes 3A-1 and 3A-2 are cross-shaped holes piercing through the short circuit plane 2*a*.

The radio wave absorbers 4A-1 and 4A-2 are cross-shaped members made of lossy material that absorbs radio waves. As the lossy material, metallic powder solidified with epoxy resin as a resistance component, or ceramic material represented by ferrite is used.

Note that, although the rectangular waveguide unit 2A is described, the waveguide unit 2A may be a cylindrical waveguide. That is, a waveguide unit 2A having a rectangular or cylindrical shape may be used as long as the waveguide has a short circuit plane 2*a* provided with the through holes 3A-1 and 3A-2.

Each of four portions of the radio wave absorber 4A-1, which projects outward from the axis, has an inclined surface 4A'-1 forming a tapered shape inclined from one end toward the other end.

Likewise, each of four portions of the radio wave absorber 4A-2, which projects outward from the axis, has an inclined surface 4A'-2 forming a tapered shape.

As illustrated in FIG. 4, the radio wave absorbers 4A-1 and 4A-2 are inserted through the through holes 3A-1 and 3A-2, respectively, toward the inside of the waveguide unit 2A, and set to a state of contacting with inner surfaces 3A'-1 and 3A'-2 of the through holes 3A-1 and 3A-2, respectively.

In other words, the through holes 3A-1 and 3A-2 are closed by the radio wave absorbers 4A-1 and 4A-2 without any gap, respectively.

With the electromagnetic field analysis simulation being carried out on the waveguide non-reflective terminator 1A, a result similar to that in FIG. 3 can be obtained. Namely, the waveguide non-reflective terminator 1A functions as a terminator by disposing the radio wave absorbers 4A-1 and 4A-2 through the through holes 3A-1 and 3A-2, respectively. As a result, it is possible to form only the waveguide unit 2A by layering fabrication separately from the radio wave absorbers 4A-1 and 4A-2, so that it is possible to provide a terminator suitable for manufacturing based on layering fabrication.

Moreover, although the configuration in which the through holes 3-1 to 3-6 are arranged along one direction in the short circuit plane 2*a* is described, the through holes may be disposed to form a zigzag arrangement.

Figure 5:
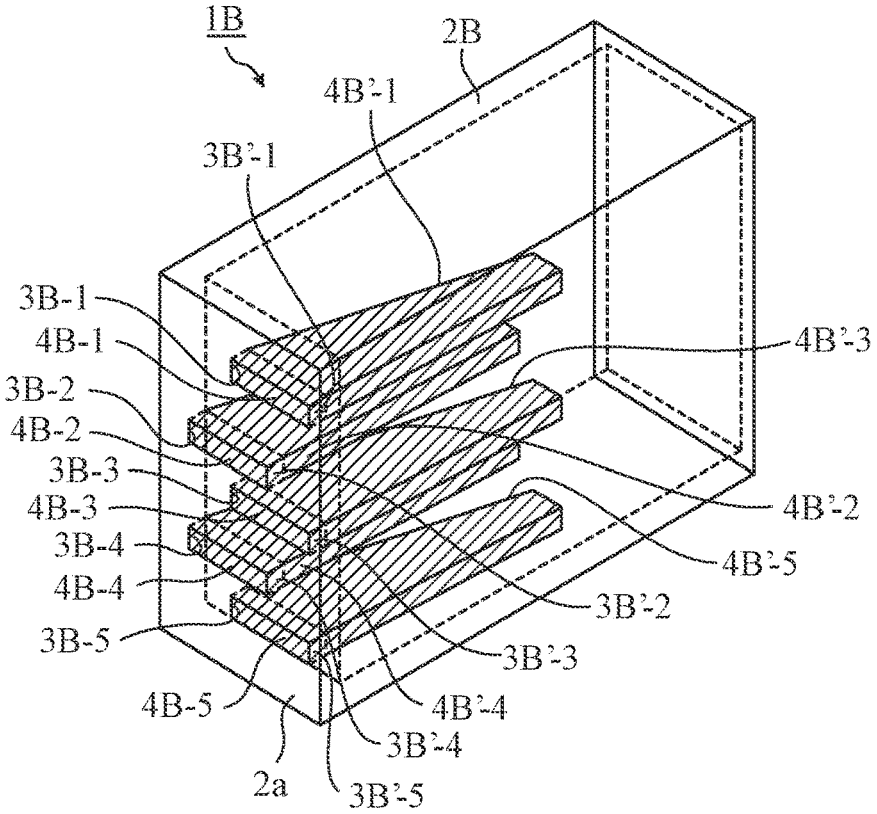
FIG. 5 is a perspective view illustrating still another configuration of the waveguide non-reflective terminator according to the first embodiment.

FIG. 5 is a perspective view illustrating still another configuration of the waveguide non-reflective terminator according to the first embodiment.

A waveguide non-reflective terminator 1B illustrated in FIG. 5 includes a waveguide unit 2B and radio wave absorbers 4B-1 to 4B-5, and causes the radio wave absorbers 4B-1 to 4B-5 to absorb (terminate) signals that propagate inside the waveguide unit 2B. The signals to be absorbed by the radio wave absorbers 4B-1 to 4B-5 are frequency signals being non-reflective targets. Note that, in FIG. 5, walls of the waveguide unit 2B are transparently illustrated to show the inside of the waveguide unit 2B.

The waveguide unit 2B is a waveguide closed at one end thereof by the short circuit plane 2*a* provided with through holes 3B-1 to 3B-5. As illustrated in FIG. 5, the through holes 3B-1 to 3B-5 are provided to form a zigzag arrangement on the short circuit plane 2*a*. In addition, each of the radio wave absorbers 4B-1 to 4B-5 is a tabular member made of lossy material that absorbs radio waves. As the lossy material, metallic powder solidified with epoxy resin as a resistance component, or ceramic material represented by ferrite is used.

Note that, although the rectangular waveguide unit 2B is described, the waveguide unit 2B may be a cylindrical waveguide. That is, a waveguide unit 2B having a rectangular or cylindrical shape may be used as long as the waveguide has a short circuit plane 2*a* provided with the through holes 3B-1 to 3B-5.

The radio wave absorbers 4B-1 to 4B-5 have inclined surfaces 43-1 to 43-5 each forming a tapered shape inclined from one end toward the other end, respectively.

The radio wave absorbers 4B-1 to 4B-5 are inserted, from their respective ends having the inclined surfaces 43-1 to 43-5 each forming a tapered shape, into the through holes 3B-1 to 3B-5, respectively.

After the insertion, the radio wave absorbers 4B-1 to 4B-5 are set to a state of contacting with inner surfaces 33-1 to 33-5 of the through holes 3B-1 to 3B-5, respectively.

In other words, the through holes 3B-1 to 3B-5 are closed by the radio wave absorbers 4B-1 to 4B-5 without any gap, respectively.

With the electromagnetic field analysis simulation being carried out on the waveguide non-reflective terminator 1B, a result similar to that in FIG. 3 can be obtained. Namely, the waveguide non-reflective terminator 1B functions as a terminator by disposing the radio wave absorbers 4B-1 to 4B-5 through the through holes 3B-1 to 3B-5, respectively. As a result, it is possible to form only the waveguide unit 2B by layering fabrication separately from the radio wave absorbers 4B-1 to 4B-5, so that it is possible to provide a terminator suitable for manufacturing based on layering fabrication.

Although the inclined surfaces 4'-1 to 4'-6, 4A'-1, 4A'-2, and 43-1 to 4B'-5, each forming a tapered shape, are described in the above, no limitation is intended.

For example, the inclined surface of the radio wave absorber may be a stepped inclined surface as long as the radio wave absorber can be inserted through the through hole in the short circuit plane 2*a* and the through hole can be closed without any gap.

In addition, although an example where all of the radio wave absorbers have the same shape has been described, no limitation is intended by this example. For example, radio wave absorbers in different shapes may be attached to the waveguide unit depending on the positions of the through holes.

As described above, the waveguide non-reflective terminator 1 according to the first embodiment includes the waveguide unit 2 and a plurality of radio wave absorbers 4-1 to 4-6. The waveguide unit 2 has one end closed by the short circuit plane 2*a* provided with the plurality of through holes 3-1 to 3-6. The radio wave absorbers 4-1 to 4-6 absorb a frequency signal being a non-reflective target in a state of being inserted through the plurality of through holes 3-1 to 3-6 toward the inside of the waveguide unit 2 and contacting with the inner surfaces 3'-1 to 3'-6 of the plurality of through holes 3-1 to 3-6.

With this configuration, the function as a terminator can be obtained by disposing the radio wave absorbers 4-1 to 4-6 in the through holes 3-1 to 3-6, respectively. It is possible to form only the waveguide unit 2 by layering fabrication separately from the radio wave absorbers 4-1 to 4-6, so that it is possible to provide a terminator suitable for manufacturing based on layering fabrication. In addition, by forming the waveguide unit 2 by layering fabrication, it is not necessary to separately manufacture a plurality of components for forming the waveguide unit 2, so that flexibility in the design of the waveguide unit 2 can be improved.

Note that the effects similar to those described above can be obtained also in the waveguide non-reflective terminators 1A and 1B.

Second Embodiment

Figure 6:
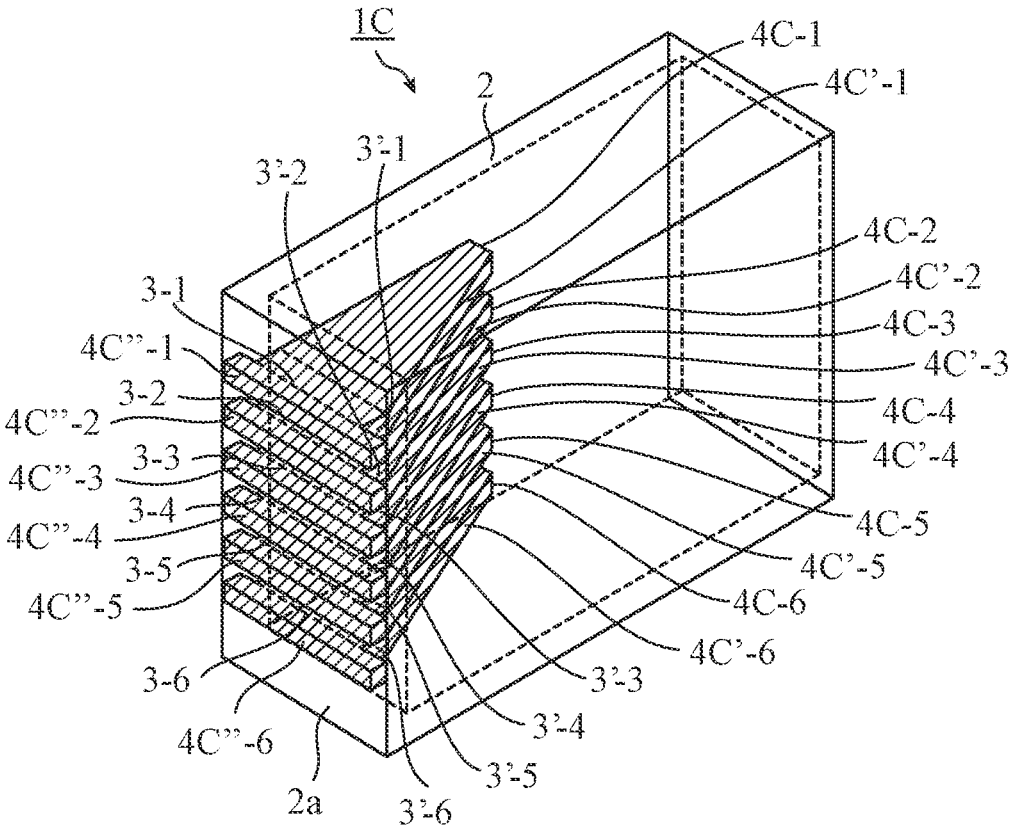
FIG. 6 is a perspective view illustrating a configuration of a waveguide non-reflective terminator according to a second embodiment of the present invention.

FIG. 6 is a perspective view illustrating a configuration of a waveguide non-reflective terminator 1C according to a second embodiment of the present invention. In FIG. 6, the same constituent elements as those in FIG. 2 are denoted by the same reference signs, and descriptions thereof will be omitted.

The waveguide non-reflective terminator 1C includes a waveguide unit 2 and radio wave absorbers 4C-1 to 4C-6, and causes the radio wave absorbers 4C-1 to 4C-6 to absorb (terminate) signals that propagate inside the waveguide unit 2. The signals to be absorbed by the radio wave absorbers 4C-1 to 4C-6 are frequency signals being non-reflective targets. Note that, in FIG. 6, walls of the waveguide unit 2 are transparently illustrated to show the inside of the waveguide unit 2.

Each of the radio wave absorbers 4C-1 to 4C-6 is a tabular member made of lossy material that absorbs radio waves. As the lossy material, metallic powder solidified with epoxy resin as a resistance component, or ceramic material represented by ferrite is used.

Note that, although the rectangular waveguide unit 2 is described, the waveguide unit 2 may be a cylindrical waveguide. That is, a waveguide unit 2 having a rectangular or cylindrical shape may be used as long as the waveguide has a short circuit plane 2*a* provided with a plurality of through holes.

Figure 7:
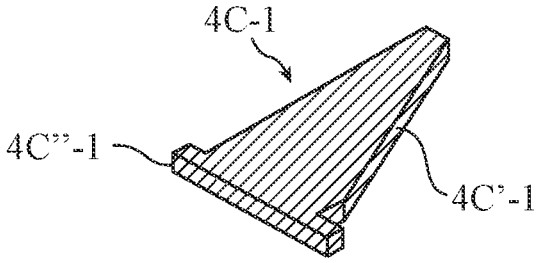
FIG. 7 is a perspective view illustrating a configuration of a radio wave absorber according to the second embodiment.

FIG. 7 is a perspective view illustrating a configuration of a radio wave absorber according to the second embodiment, which shows a radio wave absorber 4C-1 among the radio wave absorbers 4C-1 to 4C-6.

As illustrated in FIG. 7, the radio wave absorber 4C-1 has an inclined surface 4C'-1 forming a tapered shape inclined from one end toward the other end.

Further, the radio wave absorber 4C-1 has a stopper 4C"-1 whose dimension is larger than the dimension of a through hole 3-1. As illustrated in FIG. 6, the stopper 4C"-1 is a portion to be exposed to the outside of the waveguide unit 2 at the time when the radio wave absorber 4C-1 is inserted through the through hole 3-1.

The radio wave absorbers 4C-2 to 4C-6 are configured to have the same shape as the shape of the radio wave absorber 4C-1 illustrated in FIG. 7.

The radio wave absorbers 4C-1 to 4C-6 are inserted through the through holes 3-1 to 3-6, respectively, toward the inside of the waveguide unit 2.

When the stoppers 4C"-1 to 4C"-6 come into contact with the short circuit plane 2*a*, the insertion direction of the radio wave absorbers 4C-1 to 4C-6 is restricted. At this time, the radio wave absorbers 4C-1 to 4C-6 become a state of contacting with inner surfaces 3'-1 to 3'-6 of the through holes 3-1 to 3-6. In other words, the through holes 3-1 to 3-6 are closed by the radio wave absorbers 4C-1 to 4C-6 without any gap, respectively.

As described above, since all of the radio wave absorbers 4C-1 to 4C-6 have the same shape, insertion amounts of the radio wave absorbers 4C-1 to 4C-6 inserted to the through holes 3-1 to 3-6, respectively, are all the same. Accordingly, the insertion amount of each of the radio wave absorbers 4C-1 to 4C-6 is adjusted to be constant, so that the termination effect of signals due to the radio wave absorbers 4C-1 to 4C-6 can be kept constant.

Furthermore, since positions at which the stoppers 4C"-1 to 4C"-6 come into contact with the short circuit plane 2*a* are appropriate insertion positions of the radio wave absorbers 4C-1 to 4C-6, the radio wave absorbers 4C-1 to 4C-6 can be easily installed and the operation time required for installation can be shortened.

With the electromagnetic field analysis simulation being carried out on the waveguide non-reflective terminator 1C, a result similar to that in FIG. 3 can be obtained. Namely, the waveguide non-reflective terminator 1C functions as a terminator by disposing the radio wave absorbers 4C-1 to 4C-6 through the through holes 3-1 to 3-6, respectively. As a result, it is possible to form only the waveguide unit 2 by layering fabrication separately from the radio wave absorbers 4C-1 to 4C-6, so that it is possible to provide a terminator suitable for manufacturing based on layering fabrication.

Figure 8:
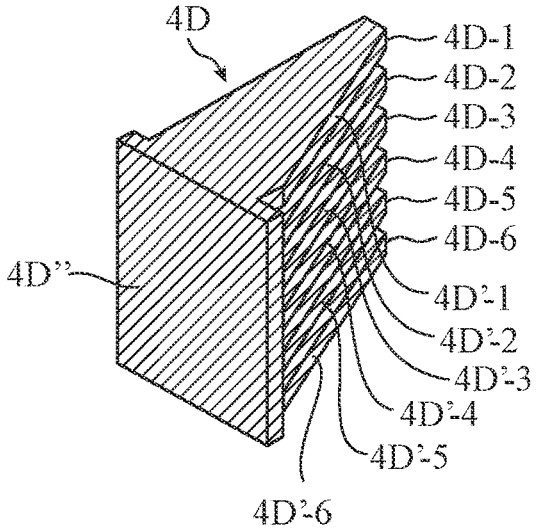
FIG. 8 is a perspective view illustrating another configuration of the radio wave absorber according to the second embodiment.

FIG. 8 is a perspective view illustrating another configuration of the radio wave absorber according to the second embodiment. A radio wave absorber 4D illustrated in FIG. 8 includes insertion portions 4D-1 to 4D-6, and a stopper 4D".

The insertion portions 4D-1 to 4D-6 are portions of the radio wave absorber 4D to be inserted into the through holes 3-1 to 3-6, respectively, which have inclined surfaces 4D'-1 to 4D'-6 each forming a tapered shape, respectively.

A stopper 4" is a portion to be exposed to the outside of the waveguide unit 2 from the through holes 3-1 to 3-6 at the time when the insertion portions 4D-1 to 4D-6 are inserted into the through holes 3-1 to 3-6, respectively.

As described above, the radio wave absorber 4D has a structure in which the stoppers 4C"-1 to 4C"-6 of the radio wave absorbers 4C-1 to 4C-6 illustrated in FIGS. 6 and 7 are integrated to form one member.

Accordingly, the insertion amount of each of the insertion portions 4D-1 to 4D-6 in the radio wave absorber 4D becomes are adjusted to be constant, whereby the termination effect of signals due to the radio wave absorber 4D can be kept constant.

Furthermore, it is only necessary to insert the insertion portions 4D-1 to 4D-6 to the position at which the stopper 4D" abuts on the short circuit plane 2*a* to attach the radio wave absorber 4D to the waveguide unit 2, whereby the operation time for installation of the radio wave absorber 4D can be shortened compared with that of the radio wave absorbers 4C-1 to 4C-6.

Note that, although the rectangular waveguide unit 2 is described, the waveguide unit 2 may be a cylindrical waveguide. That is, a waveguide unit 2 having a rectangular or cylindrical shape may be used as long as the waveguide has the short circuit plane 2*a* provided with a plurality of through holes.

As described above, in the waveguide non-reflective terminator 1C according to the second embodiment, the insertion amounts of the radio wave absorbers 4C-1 to 4C-6 inserted through the through holes 3-1 to 3-6 are all the same. Accordingly, the termination effect of signals due to the radio wave absorbers 4C-1 to 4C-6 can be kept constant.

In the waveguide non-reflective terminator 1C according to the second embodiment, the radio wave absorbers 4C-1 to 4C-6 have the stoppers 4C"-1 to 4C"-6, whereby the termination effect of signals due to the radio wave absorbers 4C-1 to 4C-6 can be kept constant.

Furthermore, since positions at which the stoppers 4C"-1 to 4C"-6 come into contact with the short circuit plane 2*a* are appropriate insertion positions of the radio wave absorbers 4C-1 to 4C-6, the radio wave absorbers 4C-1 to 4C-6 can be easily installed and the operation time for installation can be shortened.

In the waveguide non-reflective terminator 1C according to the second embodiment, portions of the radio wave absorber 4D exposed to the outside of the waveguide unit 2 from the respective through holes 3-1 to 3-6 are integrated.

With this configuration, the insertion amount of the insertion portions 4D-1 to 4D-6 in the radio wave absorber 4D are adjusted to be constant, whereby the termination effect of signals due to the radio wave absorber 4D can be kept constant.

Furthermore, since it is only necessary to insert the insertion portions 4D-1 to 4D-6 to the position at which the stopper 4D" abuts on the short circuit plane 2*a* to attach the radio wave absorber 4D to the waveguide unit 2, the operation time for installation of the radio wave absorber 4D can be shortened compared with that of the radio wave absorbers 4C-1 to 4C-6.

Third Embodiment

Figure 9:
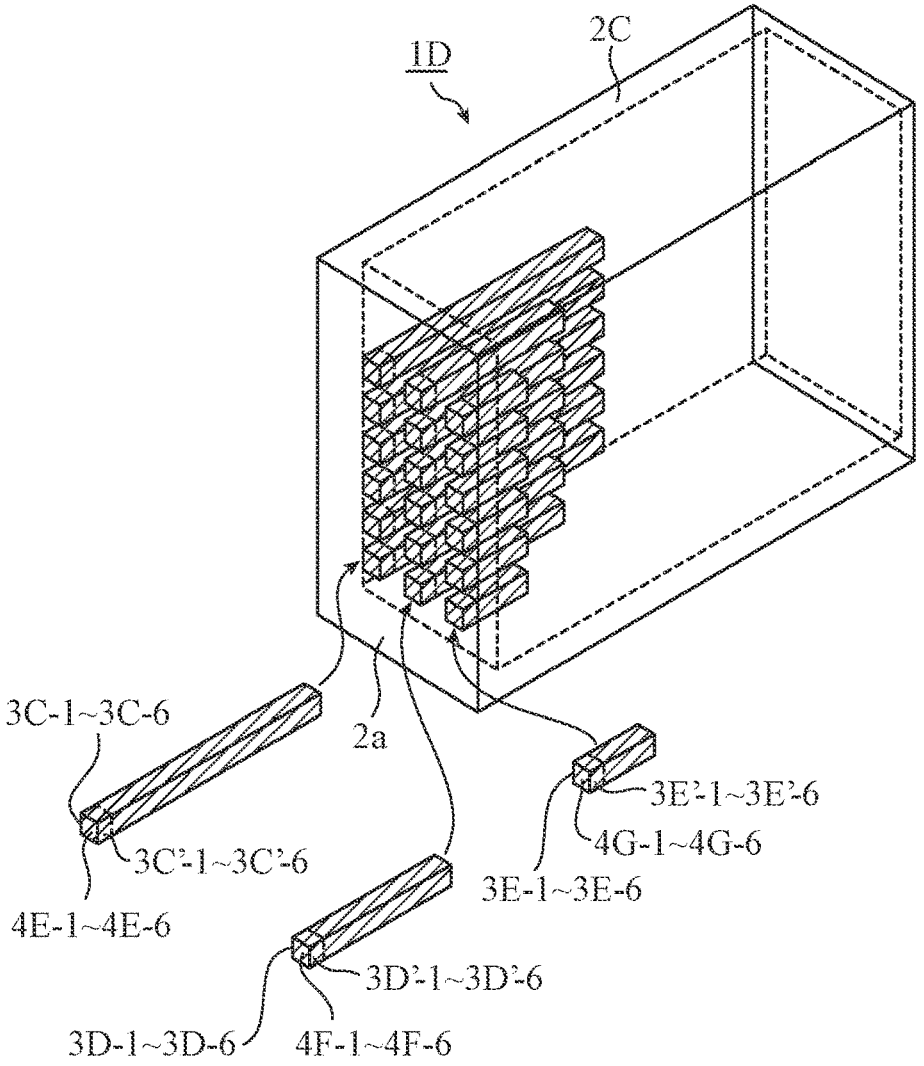
FIG. 9 is a perspective view illustrating a configuration of a waveguide non-reflective terminator according to a third embodiment of the present invention.

FIG. 9 is a perspective view illustrating a configuration of a waveguide non-reflective terminator 1D according to a third embodiment of the present invention. The waveguide non-reflective terminator 1D includes a waveguide unit 2C, and radio wave absorbers 4E-1 to 4E-6, 4F-1 to 4F-6, and 4G-1 to 4G-6. Signals that propagate inside the waveguide unit 2C are absorbed (terminated) by the radio wave absorbers 4E-1 to 4E-6, 4F-1 to 4F-6, and 4G-1 to 4G-6. The signals to be absorbed by the radio wave absorbers 4E-1 to 4E-6, 4F-1 to 4F-6, and 4G-1 to 4G-6 are frequency signals being non-reflective targets.

Note that, in FIG. 9, walls of the waveguide unit 2C are transparently illustrated to show the inside of the waveguide unit 2C.

The waveguide unit 2C is a rectangular waveguide closed at one end thereof by a short circuit plane 2*a*. The traveling direction of radio waves of the waveguide unit 2C is a direction perpendicular to the short circuit plane 2*a*. The short circuit plane 2*a* is one end face of the waveguide unit 2C, which is electrically short-circuited to close the waveguide unit 2C.

Note that, although the rectangular waveguide unit 2C is described, the waveguide unit 2C may be a cylindrical waveguide. That is, a waveguide unit 2 having a rectangular or cylindrical shape may be used as long as the waveguide has a short circuit plane 2*a* provided with a plurality of through holes.

Each of through holes 3C-1 to 3C-6, 3D-1 to 3D-6, and 3E-1 to 3E-6 is a rectangular hole piercing through the short circuit plane 2*a*, and has a dimension in which signals do not propagate in a signal frequency band. Although the rectangular through holes are illustrated in FIG. 9, the through holes 3C-1 to 3C-6, 3D-1 to 3D-6, and 3E-1 to 3E-6 may be circular holes.

That is, it is only required for the through holes 3C-1 to 3C-6, 3D-1 to 3D-6, and 3E-1 to 3E-6 to be in hole shapes corresponding to the shapes of the radio wave absorbers 4E-1 to 4E-6, 4F-1 to 4F-6, and 4G-1 to 4G-6 as long as signals do not propagate to the outside of the waveguide unit 2C through the through holes.

Each of the radio wave absorbers 4E-1 to 4E-6, 4F-1 to 4F-6, and 4G-1 to 4G-6 is a rod-shaped member made of lossy material that absorbs radio waves. As the lossy material, metallic powder solidified with epoxy resin as a resistance component, or ceramic material represented by ferrite is used.

The radio wave absorbers 4E-1 to 4E-6 are each formed to have the same length, and those lengths are longer than the lengths of the radio wave absorbers 4F-1 to 4F-6 and 4G-1 to 4G-6. The radio wave absorbers 4F-1 to 4F-6 are each formed to have the same length, and those lengths are longer than the length of the radio wave absorbers 4G-1 to 4G-6. The radio wave absorbers 4G-1 to 4G-6 are each formed to have the same length, and those lengths are shorter than the length of the radio wave absorbers 4E-1 to 4E-6 and 4F-1 to 4F-6.

The radio wave absorbers 4E-1 to 4E-6 are inserted through the through holes 3C-1 to 3C-6, respectively, toward the inside of the waveguide unit 2C, and set to a state of contacting with inner surfaces 3C'-1 to 3C'-6 of the through holes 3C-1 to 3C-6.

The radio wave absorbers 4F-1 to 4F-6 are inserted through the through holes 3D-1 to 3D-6, respectively, toward the inside of the waveguide unit 2C, and set to a state of contacting with inner surfaces 3D'-1 to 3D'-6 of the through holes 3D-1 to 3D-6.

The radio wave absorbers 4G-1 to 4G-6 are inserted through the through holes 3E-1 to 3E-6, respectively, toward the inside of the waveguide unit 2C, and set to a state of contacting with inner surfaces 3E'-1 to 3E'-6 of the through holes 3E-1 to 3E-6.

In this manner, the through holes 3C-1 to 3C-6, 3D-1 to 3D-6, and 3E-1 to 3E-6 are closed by the radio wave absorbers 4E-1 to 4E-6, 4F-1 to 4F-6, and 4G-1 to 4G-6 without any gap, respectively.

As illustrated in FIG. 9, in the waveguide non-reflective terminator 1D, the insertion amount of the radio wave absorbers 4E-1 to 4E-6 in the first row is the largest, the insertion amount of the radio wave absorbers 4F-1 to 4F-6 in the second row is the second largest, and the insertion amount of the radio wave absorbers 4G-1 to 4G-6 in the third row is the smallest.

In other words, in the waveguide non-reflective terminator 1D, the insertion amounts of the radio wave absorbers are different from one another depending on the position of the through hole.

With the electromagnetic field analysis simulation being carried out on the waveguide non-reflective terminator 1D, a result similar to that in FIG. 3 can be obtained. As a result, it is possible to form only the waveguide unit 2C by layering fabrication separately from the radio wave absorbers 4E-1 to 4E-6, 4F-1 to 4F-6, and 4G-1 to 4G-6, so that it is possible to provide a terminator suitable for manufacturing based on layering fabrication.

Furthermore, the waveguide non-reflective terminator 1D functions similarly to the waveguide non-reflective terminator 1 by attaching the radio wave absorbers 4E-1 to 4E-6, 4F-1 to 4F-6, and 4G-1 to 4G-6 to the through holes 3C-1 to 3C-6, 3D-1 to 3D-6, and 3E-1 to 3E-6, respectively.

That is, the waveguide non-reflective terminator 1D functions in a similar manner to a structure in which a radio wave absorber has a shape tapered from the third row toward the first row inside the waveguide unit 2C.

By adjusting the insertion amount of the radio wave absorber in accordance with the position of each through hole, the waveguide non-reflective terminator 1D having appropriate reflection characteristics can be implemented.

Note that, although the rod-shaped radio wave absorbers 4E-1 to 4E-6, 4F-1 to 4F-6, and 4G-1 to 4G-6 are described, the radio wave absorbers 4E-1 to 4E-6, 4F-1 to 4F-6, and 4G-1 to 4G-6 may be tapered, or may be in a shape tapered with a stepped inclined surface. Also in such a configuration, the waveguide non-reflective terminator 1D having an appropriate reflection characteristic can be implemented.

In addition, although the structure in which six radio wave absorbers are attached in each of three rows aligned with one another in the lateral direction is described as the waveguide non-reflective terminator 1D, no limitation is intended by this structure.

For example, a structure in which only one row is disposed as a structure corresponding to the above three rows which are aligned with one another in the lateral direction, and two or more radio wave absorbers are attached to the one row may be adopted. Further, a structure in which two rows are disposed in the lateral direction and one or more radio wave absorbers are attached to each of the two rows may be adopted. Namely, any waveguide non-reflective terminator may be used as long as the insertion amounts of the radio wave absorbers are different from one another depending on the positions of the through holes.

As described above, in the waveguide non-reflective terminator 1D according to the third embodiment, the insertion amounts of the radio wave absorbers 4E-1 to 4E-6, 4F-1 to 4F-6, and 4G-1 to 4G-6 are different from one another depending on the positions of the through holes 3C-1 to 3C-6, 3D-1 to 3D-6, and 3E-1 to 3E-6.

In this manner, by adjusting the insertion amount of the radio wave absorber depending on the position of the through hole, the waveguide non-reflective terminator 1D having appropriate reflection characteristics can be implemented.

Fourth Embodiment

Figure 10:
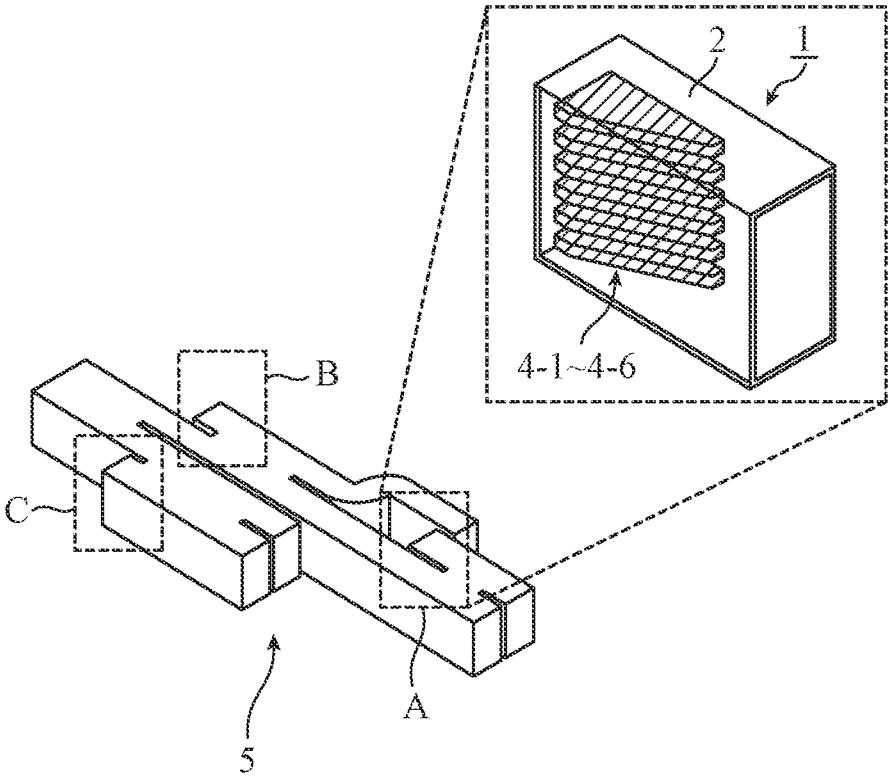
FIG. 10 is a perspective view illustrating a configuration of a waveguide circuit according to a fourth embodiment of the present invention.

FIG. 10 is a perspective view illustrating a configuration of a waveguide circuit 5 according to a fourth embodiment of the present invention.

The waveguide circuit 5 is a waveguide terminated at positions A to C surrounded by broken lines, and a waveguide non-reflective terminator 1 described in the first embodiment is provided at those positions.

As described in the first embodiment, the waveguide non-reflective terminator 1 functions as a terminator only by attaching the radio wave absorbers 4-1 to 4-6 in the through holes 3-1 to 3-6.

Therefore, in the waveguide circuit 5 provided with the waveguide non-reflective terminator 1, a routing circuit and a plate or lid for short circuiting are not required, and it is also not required to provide a choke structure.

As described above, the waveguide circuit 5 according to the fourth embodiment includes the waveguide non-reflective terminator 1.

With this configuration, the waveguide circuit 5 can be implemented by a simple circuit.

Further, the waveguide circuit can also be implemented by a simple circuit when the waveguide circuit is provided with, instead of the waveguide non-reflective terminator 1, any one of the waveguide non-reflective terminators 1A to 1D indicated in the first to third embodiments.

Furthermore, the waveguide circuit can also be implemented by a simple circuit when the waveguide circuit is provided with a combination of the waveguide non-reflective terminators 1, 1A to 1D.

Note that, in the present invention, the respective embodiments can be freely combined, any constituent element of each embodiment can be modified, and any constituent element of each embodiment can be omitted within the scope of the invention.

INDUSTRIAL APPLICABILITY

The waveguide non-reflective terminator according to the present invention can be used in a communication apparatus that uses signals of microwaves or millimeter waves.

REFERENCE SIGNS LIST

1, 1A to 1D: Waveguide non-reflective terminator, 2, 2A to 2C: Waveguide unit, 2*a*: Short circuit plane, 3-1 to 3-6, 3A-1, 3A-2, 3B-1 to 3B-5, 3C-1 to 3C-6, 3D-1 to 3D-6, 3E-1 to 3E-6: Through hole, 3'-1 to 3'-6, 3A'-1, 3A'-2, 3B'-1 to 3B'-5, 3C'-1 to 3C'-6, 3D'-1 to 3D'-6, 3E'-1 to 3E'-6: Inner surface, 4-1 to 4-6, 4A-1, 4A-2, 4B-1 to 4B-5, 4C-1 to 4C-6, 4E-1 to 4E-6, 4F-1 to 4F-6, 4G-1 to 4G-6: Radio wave absorber, 4D-1 to 4D-6: Insertion portion, 4'-1 to 4'-6, 4A'-1, 4A'-2, 4B'-1 to 4B'-5, 4C'-1 to 4C'-6, 4D'-1 to 4D'-6: Inclined surface, 4C"-1 to 4C"-6, 4D": Stopper, 5: Waveguide circuit.

The invention claimed is:

1. A waveguide non-reflective terminator, comprising:

a waveguide unit whose one end is closed by a short circuit plane provided with a plurality of through holes; and a plurality of radio wave absorbers absorbing a frequency signal being a non-reflective target in a state of being inserted through the plurality of through holes toward an inside of the waveguide unit and contacting with inner surfaces of the plurality of through holes, respectively, wherein portions of the plurality of radio wave absorbers are exposed to an outside of the waveguide unit from the plurality of through holes and are larger than the plurality of through holes, respectively.

2. The waveguide non-reflective terminator according to claim 1, wherein the waveguide unit is a rectangular waveguide.

3. The waveguide non-reflective terminator according to claim 1, wherein the waveguide unit is a cylindrical waveguide.

4. The waveguide non-reflective terminator according to claim 1, wherein the through holes are rectangular holes.

5. The waveguide non-reflective terminator according to claim 1, wherein each of the plurality of through holes is a circular hole.

6. The waveguide non-reflective terminator according to claim 1, wherein each of the plurality of through holes is a cross-shaped hole.

7. The waveguide non-reflective terminator according to claim 1, wherein the plurality of through holes has a same shape.

8. The waveguide non-reflective terminator according to claim 1, wherein the plurality of radio wave absorbers each have an inclined surface forming a tapered shape in a portion inserted through the plurality of through holes.

9. The waveguide non-reflective terminator according to claim 1, wherein the plurality of radio wave absorbers each have a stepped inclined surface in a portion inserted through the plurality of through holes.

10. The waveguide non-reflective terminator according to claim 1, wherein all insertion amounts of the plurality of radio wave absorbers respectively inserted through the plurality of through holes are same.

11. The waveguide non-reflective terminator according to claim 1, wherein insertion amounts of the plurality of radio wave absorbers respectively inserted through the plurality of through holes are different depending on respective positions of the plurality of through holes.

12. The waveguide non-reflective terminator according to claim 1, wherein portions of the plurality of radio wave absorbers are exposed to an outside of the waveguide unit from the plurality of through holes and are integrated to form one member.

13. A waveguide circuit comprising the waveguide non-reflective terminator according to claim 1.

* * * * *